United States Patent [19]

Dix et al.

[11] 4,299,170

[45] Nov. 10, 1981

[54] DEVICE FOR SIMULATING HITS ON ARMORED VEHICLES AND SIMILAR TARGETS

[75] Inventors: Ernst Dix, Schiffdorf; Gerhard Müller, Langen-Neuenwalde; Hans Nötzel, Bremerhaven; Willy Walther, Bremerhaven; Detlef Zahn, Bremerhaven, all of Fed. Rep. of Germany

[73] Assignee: Comet GmbH Pyrotechnik Apparatebau, Fed. Rep. of Germany

[21] Appl. No.: 76,378

[22] Filed: Sep. 17, 1979

[30] Foreign Application Priority Data

Sep. 21, 1978 [DE] Fed. Rep. of Germany ..... 2841059

[51] Int. Cl.[3] ..... C06D 1/04

[52] U.S. Cl. ..... 102/355; 102/352; 102/360

[58] Field of Search ..... 102/37.3, 37.2, 201, 102/215, 216

[56] References Cited

U.S. PATENT DOCUMENTS

| | | | |
|---|---|---|---|
| 1,381,371 | 6/1921 | Wanklyn | 102/37.7 |
| 3,298,311 | 1/1967 | Catlin | 102/37.8 X |
| 3,722,415 | 3/1973 | Lunt | 102/216 |
| 3,812,783 | 5/1974 | Yang et al. | 102/201 |
| 4,014,262 | 3/1977 | Betts | 102/37.2 X |
| 4,147,109 | 4/1979 | Ziemba | 102/215 |
| 4,214,534 | 7/1980 | Richter et al. | 102/215 |

*Primary Examiner*—Peter A. Nelson

*Attorney, Agent, or Firm*—McGlew and Tuttle

[57] ABSTRACT

A device for simulating hits on a target for example in war games and particularly for simulating hits on armored vehicles comprises a housing which has a plurality of separate spaced apart charge receiving chambers therein. Each chamber contains a distinct charge preferably including but not limited to a so-called fireball type of charge, a smoke type charge and a report type charge. The charges are arranged in separate cups or compartments and the first charge is connected to an igniter which may for example be an ignition system which is set off by an external pulse of light. The other charges are connected to the first charge and to each other through pyrotechnical propagation charges which may or may not have a delay operation so that they are set off in a controlled sequence.

4 Claims, 2 Drawing Figures

DEVICE FOR SIMULATING HITS ON ARMORED VEHICLES AND SIMILAR TARGETS

BACKGROUND OF THE INVENTION

Field of the Invention

This invention relates in general to pyrotechnical devices and in particular to a new and useful device particularly adapted for indicating hits on targets and which includes a plurality of separate signal charge compositions.

The devices for indicating hits on targets such as moving vehicles are known for example as shown in U.S. Pat. No. 3,722,418; Canadian Pat. No. 9,997,960 and Swiss Pat. No. 535,727.

To simulate gun shots or hits during military practice or maneuvers, it is known to equip wheeled or tracklaying vehicles with devices for firing pyrotechnical detonating bodies. With such devices, shots or hits can be simulated acoustically and optically. The pyrotechnical bodies are detonated electrically by the crew of the practicing armored vehicle.

In prior art devices, while igniting and setting off the detonating body, thus simulating the shot, a pulse of light is transmitted simultaneously, which, if a hit is scored, is automatically registered by the fought or opposed vehicle. Such a hit is indicated on the opposed vehicle, for example, by an electric lamp which is switched on by the transmitted pulse of light. The lighting up of the lamp is an indication for the umpire that the fought vehicle has been hit and is to be eliminated from further combat exercise.

This manner of simulating shots and hits has proved satisfactory in general, however, under many combat and weather conditions, the lighting up of a hit indicating lamp is not sufficiently perceivable. For example, if the vehicle is disguised by camouflage, or during invisibility caused by fog, etc.

In view of these limits given by the concept of the devices, it has been proposed (German Utility Model No. 7,714,039), while still utilizing the fire equipment and the basic structure and mode of operation of the known pyrotechnical bodies employed for simulating shots and hits, to provide the pyrotechnical body with a pyrotechnical flare composition. The geometry and spatial accommodation of this flare composition in the pyrotechnical body corresponds to those of a detonating composition. As to making use of the flare composition, it has further been proposed to designate only one of the many discharging cups of which the firing device is assembled, for receiving the pyrotechnical body comprising the flare composition.

Even though this alternative arrangement of a detonating and a flare composition in the pyrotechnical body would meet the requirements of simulating hits better and in a way closer to actual combat conditions, it still does not correspond to all possible or imaginable hit patterns on or in armored wheeled or tracklaying vehicles. For this reason, the present invention is directed to a pyrotechnical body simultaneously comprising a plurality of different signal compositions.

In accordance with the present invention, a firing device which may be set off for example by a light control such as a laser control includes a housing containing a plurality of separate compartments which are filled with separate types of signal charges and which are arranged so that they may be set off at separate timed intervals. The signal charges advantageously include a fireball signal composition which is connected by pyrotechnic ignition devices to a smoke signal charge which in turn is connected to a report signal charge. The pyrotechnic igniting devices may advantageously include delay means for effecting the delay between the various charges and the charges may be arranged in any desired sequence.

A development of the inventive idea provides that by arranging the signal compositions in a pyrotechnical body spatially behind or above one another, it becomes easy to selectively obtain the following signalling sequences:

1. report-fire ball-smoke
2. report-smoke-fire ball
3. smoke-fire ball-report, and
4. fire ball-smoke-report.

According to a further development of the invention, a laser-produced pulse of external light may be used for igniting the respective first signal composition.

The invention has a variety of advantages:

Aside from the possibility of further utilizing the commonly employed firing devices with their discharging cups even while applying the invention, the geometry of the pyrotechnical bodies themselves is not changed or modified either.

The principle advantage of the invention is that the fighting units may now selectively simulate any pattern of hits occurring during practice or maneuvers, on or in armored wheeled or tracklaying vehicles.

Accordingly it is an object of the invention to provide a firing device for indicating target hits particularly on armored wheeled or tracklaying vehicles which comprises a housing having a plurality of separate spaced apart charge receiving chambers therein, one of the chambers containing a distinct first signal charge composition and at least one of the others containing a second signal charge composition and wherein the first and second charge compositions are disposed in spaced relationship with means for igniting the first composition being connected to the first signal charge and pyrotechnical propagation charge means disposed between the remainder of the signal charges and the first signal charge for selectively igniting the charges in a controlled sequence.

A further object of the invention is to provide a firing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
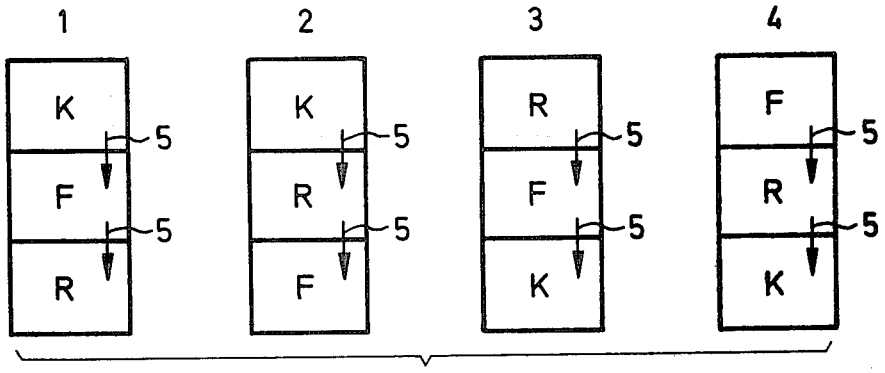
FIG. 1 is a diagrammatical showing of the various combinations of signal compositions in an example of the invention using three different types of signal charges.

Referring to the drawings in particular, the invention embodied therein comprises a firing device which is adapted to be employed for indicating hits on targets and warfare simulation exercises and which advantageously comprises a pyrotechnic body 6 defining a housing in which there are a plurality of chambers which are adapted to contain separate signal charge compositions.

The individual variants of signal composition arrangement are designated 1, 2, 3 and 4 in FIG. 1. Within these variants, the individual signal compositions are designated F, K, R, with the understanding that F means fireball, K means report and R means smoke.

The propagation charges needed for igniting the respective second and third signal compositions are indicated as arrows 5 pointing in the priming direction.

Figure 2:
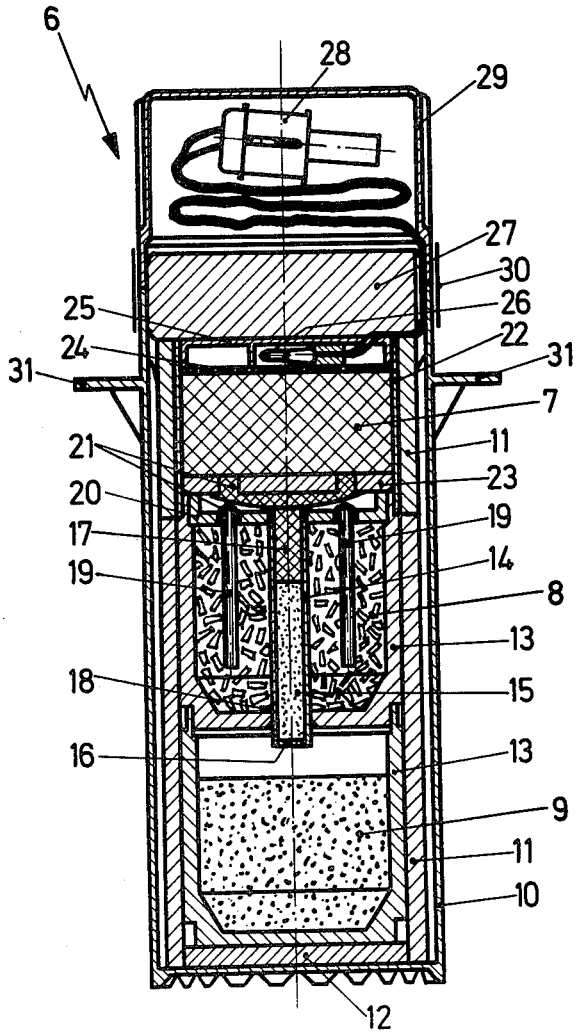
FIG. 2 is a vertical sectional view of a pyrotechnical firing device comprising signal charge compositions arranged in accordance with variant fire ball-smoke-report.

A pyrotechnical body generally designated 6 as shown in FIG. 2 is of conventional design as to its geometric outline. This ensures that it fits the conventional discharging cups (not shown) employed in the armed forces.

In the housing of the pyrotechnical body 6 is arranged a fireball signal composition 7, a smoke signal composition 8, and a report signal composition 9. The signal compositions 7, 8 and 9 are accommodated spatially behind or above one another. The arrangement shown in FIG. 2 corresponds to variant 4 of FIG. 1.

Pyrotechnical body 6 comprises a housing with an outer shell 10 and an inner shell 11 of more than one part. At its bottom, inner shell 11 is closed by a disc 12.

Within inner shell 11, there are two casings including an upper casing 13' and a lower casing 13 mounted one above the other. In lower casing 13, the report signal composition 9 is received. The smoke signal composition 8 is received in upper casing 13.

An ignition charge 15 and an igniter delay composition charge 17 are received in a case 14 which is disposed within the smoke signal composition 8. At its bottom, case 14 is provided with a seal 16. Case 14 is fixed to the upper casing 13 by means of an adhesive 18.

Fuzes (quickmatches) 19 supported on an apertured cover 20 extend into smoke signal composition 8. Igniter charge bodies 21 are provided between apertured cover 20 and a bottom 23 which is fitted in a sleeve 22. The fireball composition 7 is accommodated in sleeve 22, above bottom 23 or igniter bodies 21. An ignition charge layer 24 is provided on top of the fireball composition. A primer capsule 26 is accommodated in a cover 25 above the ignition charge layer 24.

On top of a cover 25, a filler piece 27 is received in the outer shell 10. A protective cap 29 accommodates a plug 28' with a short-circuit cap 28. The plug 28' is connected to the primer capsule 26. Outer shell 10 and protective cap 29 are attached to each other by a closure strip 30.

Fixing flanges 31 serve the purpose of supporting pyrotechnical body 6 in the discharging cup (not shown).

By means of a pyrotechnical body 6 thus constructed, the individual signal compositions 7, 8 and 9 are ignited in the desired manner.

While specific embodiments of the invention have been shown and described in detail to illustrate the application of the principles of the invention, it will be understood that the invention may be embodied otherwise without departing from such principles.

We claim:

1. A firing device for indicating hits on targets particularly on armored, wheeled or tracklaying vehicles so as to simulate hits on an assumed adversaries target, comprising a housing having a plurality of separate spaced apart charge-receiving chambers therein, at least one of said chambers containing a distinct first signal charge composition and at least one of the other of said chambers containing at least one second signal charge composition, said first and second signal charge compositions being disposed in spaced relationship to each other, means for igniting the first charge composition, and pyrotechnical propagation charge means disposed between the remainder of said signal charge composition and the first signal charge composition for selectively igniting said charge compositions in a controlled sequence, wherein said housing chambers are arranged one behind the other wherein said first signal charge composition comprises a report signal composition, said second signal charge composition including a fireball charge composition arranged behind said report composition and a smoke charge composition arranged behind said fireball composition.

2. A firing device for indicating hits on targets particularly on armored, wheeled or tracklaying vehicles so as to simulate hits on an assumed adversaries target, comprising a housing having a plurality of separate spaced apart charge-receiving chambers therein, at least one of said chambers containing a distinct first signal charge composition and at least one of the other of said chambers containing at least one second signal charge composition, said first and second signal charge compositions being disposed in spaced relationship to each other, means for igniting the first charge composition, and pyrotechnical propagation charge means disposed between the remainder of said signal charge composition and the first signal charge composition for selectively igniting said charge compositions in a controlled sequence, wherein said first and second signal compositions comprise a report-smoke and fireball charge composition arranged so that said pyrotechnical propagation charge means ignites them one after the other.

3. A firing device for indicating hits on targets particularly on armored, wheeled or tracklaying vehicles so as to simulate hits on an assumed adversaries target, comprising a housing having a plurality of separate spaced apart charge-receiving chambers therein, at least one of said chambers containing a distinct first signal charge composition and at least one of the other of said chambers containing at least one second signal charge composition, said first and second signal charge compositions being disposed in spaced relationship to each other, means for igniting the first charge composition, and pyrotechnical propagation charge means disposed between the remainder of said signal charge composition and the first signal charge composition for selectively igniting said charge compositions in a controlled sequence, wherein said first and second signal compositions comprises a smoke, fireball and report charge compositions arranged to be fired in that order.

4. A firing device for indicating hits on targets particularly on armored, wheeled or tracklaying vehicles so as to simulate hits on an assumed adversaries target, comprising a housing having a plurality of separate spaced apart charge-receiving chambers therein, at least one of said chambers containing a distinct first signal charge composition and at least one of the other of said chambers containing at least one second signal charge composition, said first and second signal charge compositions being disposed in spaced relationship to each other, means for igniting the first charge composition, and pyrotechnical propagation charge means disposed between the remainder of said signal charge composition and the first signal charge composition for selectively igniting said charge compositions in a controlled sequence, wherein the first and second signal compositions are such that the fireball, smoke and report charge composition are disposed spatially behind or above one another.

* * * * *